United States Patent [19]

Podszun et al.

[11] Patent Number: 4,885,191

[45] Date of Patent: Dec. 5, 1989

[54] PIGMENT COATED WITH POLYCYANOACRYLATE AND A PROCESS FOR COATING PIGMENTS

[75] Inventors: Wolfgang Podszun; Helmut Waniczek, both of Cologne, Fed. Rep. of Germany

[73] Assignee: Bayer Aktiengesellschaft, Leverkusen, Fed. Rep. of Germany

[21] Appl. No.: 198,105

[22] Filed: May 24, 1988

Related U.S. Application Data

[63] Continuation of Ser. No. 851,474, Apr. 14, 1986, abandoned.

[30] Foreign Application Priority Data

Apr. 25, 1985 [DE] Fed. Rep. of Germany ..... 3514886

[51] Int. Cl.[4] ..... B05D 7/00

[52] U.S. Cl. ..... 427/212; 106/499; 427/221; 428/407

[58] Field of Search ..... 106/499; 526/297; 428/407, 402.24, 221; 427/213.34, 212, 221

[56] References Cited

U.S. PATENT DOCUMENTS

| | | | |
|---|---|---|---|
| 4,191,672 | 3/1980 | Salome et al. | 427/213.34 |
| 4,337,169 | 6/1982 | Shimazaki | 427/213.34 |
| 4,452,861 | 6/1984 | Okamoto et al. | 428/402.24 |

FOREIGN PATENT DOCUMENTS 2234359 1/1975 France .

OTHER PUBLICATIONS

"Concise Chemical & Technical Dictionary", Chemical Publishing Co., Inc., New York, NY (1974).

Hackh's Chemical Dictionary, 3rd. Ed., McGraw-Hill Book Company, Inc., New York, NY (1944).

*Primary Examiner*—Amelia Burgess Yarbrough

*Attorney, Agent, or Firm*—Connolly & Hutz

[57] ABSTRACT

The invention relates to a pigment coated with polycyanoacrylate and to a process for coating pigments.

8 Claims, No Drawings

PIGMENT COATED WITH POLYCYANOACRYLATE AND A PROCESS FOR COATING PIGMENTS

This application is a continuation of Ser. No. 851,474, filed Apr. 14, 1986, now abandoned.

This invention relates to a pigment coated with polycyanoacrylate and to a process for coating pigments.

Numerous polymeric substances of various compositions have been proposed for the covering and coating of inorganic and organic pigments. Solid particles, for example phosphorescent substances, which are covered with polycyanoacrylate are known from US-PS No. 4 452 861. During production of these covered particles, polymerisation of the monomeric cyanoacrylate is initiated by small quantities of water which may be adsorbed, for example on the solids surface or may be in the solvent. With this covering process, no chemical bond is formed between the solids surface and the polymer coating. These cotaings are less stable, for example, to attacks by solvents and binders.

It has now been found that pigments can be coated with polycyanoacrylate by triggering anionic polymerisation of the monomeric cyanoacrylate by means of the actual pigment surface.

The invention accordingly relates to a pigment which is coated with polymer, preferably an inorganic or organic pigment with a basic or neutral surface, characterised in that the polymer coating is composed of polycyanoacrylate.

The invention also relates to a process for coating a basic or neutral pigment, characterised in that cyanoacrylate is polymerised in an aprotic solvent in the presence of the dispersed pigment.

Suitable pigments include known organic and inorganic, preferably organic, pigments.

Suitable inorganic pigments include, for example, oxidic titanium pigments, chromium pigments, iron pigments etc.

Suitable organic pigments include, for example, azo dyes, xanthene dyes, phthalocyanine dyes of the type described, for example, in DE-OS No. 2 944 021, triphenylmethane dyes, acridine dyes, azine dyes etc.

The pigments which may be used according to the invention generally have a pH value of from 6 to 12, preferably from 7 to 11, in a pigment-water suspension.

The pH value may be determined in a simple manner, for example by measurement using a glass electrode in a pigment water-suspension (for example according to DIN 53 200). It may also be possible to influence the pH value by an acidic or alkaline, preferably alkaline, pretreatment of the pigment. A desired pH value, for example, may thus be adjusted.

The water content of the pigments may be important for their use according to the invention. Pigments having a water content of from 0 to 1% by weight, preferably from 0 to 0.10% by weight, of water may generally be used.

Pigments having a wide variety of colours may be used, for example red, yellow, blue, green, white, black pigments etc.

Suitable black pigments include, for example, basic types of carbon black. Carbon black having a primary particle size of from 20 to 80 nm, a BET specific surface area of from 20 to 150 $m^2/g$ and a pH value of from 8 to 10 is preferred.

Suitable dye pigments not requiring pretreatment include, for example, helio fast blue HG (C.I. no. 74160), beacon pink (C.I. no. 45160) and helio fast yellow GRN (C.I. no. 21100).

Cyanoacrylates corresponding to formula (I)

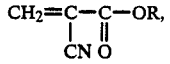

$$CH_2{=}\underset{\underset{CN}{|}}{C}{-}\underset{\underset{O}{\|}}{C}{-}OR, \qquad (I)$$

in which

R represents alkyl, in particular with from 1 to 10 carbon atoms, alkenyl with from 2 to 10 carbon atoms, cycloalkyl, in particular cyclohexyl, alkenyl, in particular allyl, aryl, in particular phenyl, and aralkyl, in particular benzyl, are preferably used for coating the pigment.

The above-mentioned subsituents can in turn be substituted by substituents which are conventional in the field of polycyanoacrylates, for example by alkyl groups.

Preferred examples include ethyl, methyl, butyl, isobutyl, amyl, allyl and lauryl cyanoacrylate and methoxyethyl cyanoacrylate, and most preferably isobutyl cyanoacrylate and allyl cyanoacrylate.

Mixtures of the acrylates may be used, mixtures which contain alkenyl cyanoacrylates being preferred. Mixtures containing from 5 to 50% by weight of allyl cyanoacrylate are particularly desirable.

The monomeric cyanoacrylate is preferably used in such quantities by weight that the ratio by weight of pigment to polymer coating is from 1:2 to 1:0.01, preferably from 1:0.5 to 1:0.05.

The cyano-acrylate is preferably polymerised in dispersion for coating the pigment with polycyanoacrylate. Aprotic solvents are suitable as dispersion medium. Hydrocarbons and halogen hydrocarbons are particularly suitable.

Dispersion media based on hydrocarbons are preferred, for example aromatic hydrocarbons such as benzene, toluene or xylene or aliphatic $C_6$–$C_{15}$-hydrocarbons such as n-hexane, cyclohexane, n-heptane, n-octane or decalin. Mixtures of different hydrocarbons can also be used. The dispersion media are generally rendered absolute, before being used, by conventional processes.

The dispersion can be produced with conventional dispersion devices, for example rapid stirrers or mills and also by ultrasound and by the application of bead or pearl mills.

It may be beneficial to use a dispersion auxiliary when preparing the dispersion.

Soluble, high-molecular weight compounds such as homo or mixed polymers of (meth)acrylic acid esters, for example a 1:1 mixed polymer of isobutyl methacrylate and lauryl methacrylate, can be used as dispersion auxiliaries. Mixed polymers having a content of from 0.1 to 15% by weight of polymerised monomers with OH groups, for example 2-hydroxyethyl methacrylate, are very suitable.

Block copolymers, for example styrene-stearyl methacrylate block copolymers or mercaptan-modified styrene butadiene block copolymers (DE-A 34 12 085) are particularly suitable dispersion auxiliaries.

Particle sizes in the range of from 0.1 to 10 μm, preferably from 0.2 to 2 μm, are generally adjusted during dispersion. The pigment is coated by addition of the monomeric cyanoacrylates, preferably using a run-in process, for example over a period of from 10 to 120 minutes. Polymerisation generally takes place under the catalytic effect of the pigment and leads to high polymer conversions, generally exceeding 70%, in short reaction times, the resultant polymer being formed as a coating on the pigment surface.

The polymerisation temperature can lie in the temperature range of from 0° to 80° C.

The coated pigment can be isolated, for example by evaporation of the dispersion medium. It is also possible, for example, to use filtration. Centrifugation can also be a suitable working-up method, particularly with very finely divided pigments.

The pigment according to the invention which is coated with polycyanoacrylate is suitable, for example, for the production of printing pastes. It can easily be dispersed and incorporated in high proportions into binders. It is also suitable for the colouring of thermoplastic materials and leads to coloration of high brilliance and intensity.

A further application of the pigment coated according to the invention is its use as an electrostatographic developer, in particular as a suspension developer. To produce a suspension developer, the dispersion of the coated pigment, which generally contains one of the dispersion auxiliaries described above, is reacted with a control substance which causes electrostatic charging of the pigment particle. Oil-soluble ionogenic compounds such as metal salts of longchained organic acids are suitable as the control substance. Mixtures of various control substances, for example a mixture of various control substances with opposing charge effects, can also be used. The intensity of charging on the toner or the polarity thereof can then be adjusted by altering the mixing ratio of the two control substances (for example, GB-PS 1 411 287, 1 441 537 and 1 411 739). Particularly suitable, positively acting control substances are described in GB-PS 1 151 141. These control substances are divalent or trivalent metal salts of an oxyacid derived from phosphorus and containing an organic radical.

In addition to the control substance, the suspension developer can of course contain other additives which are conventional in this field, for example adhesives and fixing agents. The liquid developer is distinguished, in particular, by a high charge stability and low conductivity of the dispersion medium.

EXAMPLE 1

A. Synthesis of a dispersion auxiliary 1000 ml of cyclohexane, 5 ml of glycol dimethylether and 50 g of styrene are placed in a 2 liter glass autoclave in the absence of water and oxygen. The mixture is carefully titrated to light yellow coloration with a 1 molar n-butyl lithium solution in n-hexane. 3 ml of the 1 molar butyl lithium solution are then added. The polymerisation temperature is held at 40° C. by external cooling. After a reaction time of 60 minutes, 50 g of butadiene are added and the mixture is polymerised at 50° C. for 60 minutes. The conversion is complete thereafter. 48 ml of n-dodecylmercaptan and 0.5 g of azodiisobutyronitrile are added and the mixture is heated for 5 hours to 80° C. After cooling to room temperature, the block copolymer is precipitated from the cyclohexane solution using 2000 ml of ethanol to which 2 g of 2,6-ditertiary butyl-p-methylphenol have been added, and is dried to constant weight under vacuum. 140 g of a colourless block copolymer are obtained. $[\eta]=0.262$ gl/g, toluene, 25° C.; 4.5% by weight of sulphur in the polymer.

B. Production of a pigment dispersion 40 g of carbon black pigment having a particle size of 50 nm, a BET specific surface area of 30 $m^2/g$ and a pH value according to DIN 53 200 of 8.5 are mixed in the absence of moisture together with 8 g of dispersion auxiliary from A and 152 g of dry isododecane for 16 hours in a steel bead mill, forming a stable dispersion.

C. Coating of the dispersed pigment with polycyanoacrylate

In each case, 100 g of the dispersion from B are transferred into a stirrer reactor in the absence of moisture. 1, 10, 20 and 40 g of isobutyl cyanoacrylate dissolved in dry isododecane are then added dropwise with stirring at room temperature over a period of 30 minutes. The mixture is stirred for a further 2 hours on completion of addition. The coated pigment is isolated by centrifugation, washed with isodedecane and dried. The degree of conversion is determined by N-analysis.

| Isobutyl methacrylate | conversion | diameter nm* |
|---|---|---|
| 5% (based on pigment) | 92.0% | 405 |
| 50% (based on pigment) | 88.6% | 398 |
| 100% (based on pigment) | 94.0% | 423 |
| 200% (based on pigment) | 93.0% | 495 |

*measured by laser scattered-light spectroscopy

EXAMPLE 2

24 g of helio fast blue HG (C.I. no. 74160), 6 g of a copolymer formed from 75% of lauryl methacrylate and 25% of isobutyl methacrylate with a molecular weight of 150 000, and 210 g of isododecane are mixed for 10 hours using a bead vibrating mill. 100 g of the dispersion obtained are diluted with 100 g of isododecane and reacted with vigorous stirring over a period of 30 minutes at 25° C. with a mixture of 4.5 g of isobutyl cyanoacrylate and 1.5 g of allyl cyanoacrylate. The dispersion was stirred for a further 2 hours at 25° C., then centrifuged and the isolated solid matter was washed with isododecane, centrifuged again and dried. 30 g of coated blue pigment are obtained.

EXAMPLE 3

Example 2 was repeated using helio fast yellow GRN (C.I. 21100). 30 g of coated yellow pigment are obtained.

We claim:

1. A process for coating a basic or neutral pigment comprising first forming a dispersion comprising the pigment in an aprotic medium containing a cyanoacrylate monomer and a dispersion auxiliary, where the pigment has a particle size of 20 to 80 nm and where the dispersion auxiliary is a soluble polymer formed from at least one (meth) acrylic acid ester, then coating the thus-formed dispersed pigment by polymerizing cyanoacrylate.

2. A polycyanoacrylate coated basic or neutral pigment produced by the process in accordance with claim 1.

3. A polycyanoacrylate coated basic or neutral pigment produced by the process in accordance with claim 1, wherein the ratio of the weight of the pigment to the weight of the polycyanoacrylate coating is from 1:2 to 1:0.01.

4. A process as claimed in claim 1, where the polymer contains from 0.1 to 15% by weight of a (meth)acrylic acid ester with OH groups.

5. A process as claimed in claim 4, where the (meth)acrylic acid ester with OH groups is 2-hydroxy ethyl methacrylate.

6. A process as claimed in claim 1, where the polymer is a block copolymer.

7. A process as claimed in claim 6, where the block copolymer is a styrene-stearyl methacrylate block copolymer or a mercaptan-modified styrene butadiene block copolymer.

8. A process as claimed in claim 1, where the dispersion auxiliary is a 1:1 mixed polymer of isobutyl methacrylate and lauryl methacrylate.

* * * * *